United States Patent [19]

Borgis

[11] Patent Number: 4,988,912

[45] Date of Patent: Jan. 29, 1991

[54] ELECTRIC LAMP AND METHOD OF MANUFACTURING SAME

[75] Inventor: Livio Borgis, S. Antonino, Italy

[73] Assignee: U.S. Philips Corporation, New York, N.Y.

[21] Appl. No.: 1,737

[22] Filed: Jan. 9, 1987

[30] Foreign Application Priority Data

Nov. 19, 1986 [NL] Netherlands ..... 8602929

[51] Int. Cl.[5] ..... H01J 5/26; H01J 9/34; H01K 1/46

[52] U.S. Cl. ..... 313/318; 439/611; 445/27

[58] Field of Search ..... 313/318, 51; 339/93 L, 339/94 L, 119 L, 146; 174/110 R; 445/27

[56] References Cited

U.S. PATENT DOCUMENTS 2,850,397 9/1958 Dereich ..... 106/83
3,622,947 11/1971 Griffin ..... 313/318
3,631,379 12/1971 Wright ..... 313/318
4,521,485 6/1985 Tondre et al. ..... 174/110 R

FOREIGN PATENT DOCUMENTS 1380720 1/1975 United Kingdom .

*Primary Examiner*—Kenneth Wieder
*Attorney, Agent, or Firm*—Norman N. Spain

[57] ABSTRACT

The electric lamp has a lamp vessel (1) having an end portion (3) which is fixed in the lamp cap (5) by means of polyetherimide (8) as a thermoplastic synthetic resin, which has adhered both to the lamp vessel and to the lamp cap. The end portion (3) can have non-circular cross-sections where it is in contact with the synthetic resin (8). A current supply wire (11) can be clamped between the synthetic resin (8) and the sheath portion (6) of the lamp cap (5) in order to establish electrical contact therewith. The lamp can be assembled by arranging in the hot state of the end portion (3) a polyetherimide ring (8) around this end portion (3) and by providing the lamp cap (5) in the hot state around the polyetherimide ring (8).

11 Claims, 2 Drawing Sheets

ELECTRIC LAMP AND METHOD OF MANUFACTURING SAME

BACKGROUND OF THE INVENTION

The invention relates to an electric lamp provided with:

- a translucent lamp vessel having an axis and an end portion,
- a light source in the lamp vessel,
- a lamp cap comprising a sheath portion and a base portion, to which an end portion of the lamp vessel is adhesively bonded by means of a thermoplastic synthetic resin which synthetic resin adheres both to the lamp vessel and to the lamp cap, the lamp cap having an electric contact to which a current supply conductor to the light source is connected.

The invention further relates to the manufacture of such a lamp. Such a lamp is known from British Patent Specification No. 1,380,720.

In the known lamp, the lamp cap is bonded to the lamp vessel by means of a synthetic resin, for example a thermoplastic synthetic resin of the kind of which in this known lamp the lamp cap consists, i.e. a polysulphone or a polyketone. A ring of this polymer is arranged to surround the end portion of the lamp vessel and is caused to melt. Subsequently, the lamp cap is provided and a butt joint is obtained between the lamp vessel and the lamp cap by cooling the assembly.

It has been found that with the use of a this synthetic resin lamps are obtained which do not satisfy the IEC standard. In particular the adhesion of the polymer to the lamp vessel is too poor for the requirements imposed on the torsional strength of the connection between the lamp vessel and the lamp cap.

BRIEF SUMMARY OF THE INVENTION

The invention has for its object to provide an electric lamp of the kind mentioned in the opening paragraph which can readily be manufactured and of which the connection between the lamp vessel and the lamp cap has an improved torsional strength.

According to the invention, this object is achieved in an electric lamp of the kind mentioned in the opening paragraph by the use of polyetherimide as the thermoplastic synthetic resin.

DETAILED DESCRIPTION OF THE INVENTION

Figure 1:
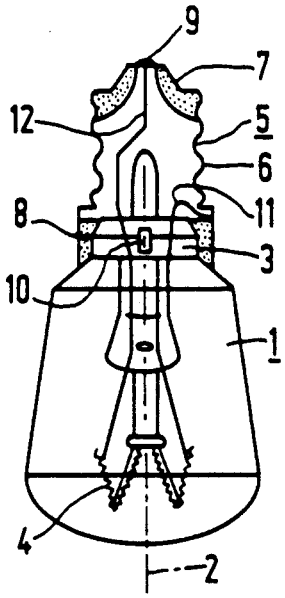
FIG. 1 shows in side elevation with the lamp cap in longitudinal sectional view.

In a favorable embodiment, the synthetic radially bands, i.e. in directions transverse to the axis of the lamp vessel, the end portion of the lamp vessel to the lamp cap. This embodiment is advantageous because in this case there is a comparatively large surface of application for the synthetic resin both to the lamp vessel and to the lamp cap. Moreover, size differences in these components are then more readily adjusted for and the lamp cap can be more readily positioned correctly coaxially to the lamp vessel. The lamp vessel, the synthetic resin and the lamp cap are then arranged substantially coaxially.

The torsional strength of the connection between the lamp vessel and the lamp cap is even considerably larger if the end portion of the lamp vessel has a projection which extends transversely to the axis of the lamp vessel and projects into the synthetic resin. Such a projection neutralizes shearing forces in the interface between the lamp vessel and the synthetic resin. The uniformity of the forces in this interface is large if several, for example two or more, of such projections are distributed along the circumference of the end portion. Such projections are readily provided during the operation in which the end portion of the lamp vessel is shaped. This operation is a normal step in the manufacture of conventional lamps of which the lamp vessel is fixed in the lamp cap by means of cement.

Such an effect on the torsional strength is obtained if the end portion of the lamp vessel is not round, i.e. is non-circular in cross-sections transverse to the axis of the lamp vessel. The end portion may be, for example, oval in cross-sections or may have one or more depressions, for example transversal or axial grooves, in which the thermoplastic synthetic resin has adhered and which are filled with this synthetic resin. The projections mentioned in the preceding paragraph have a particular advantage, however, which will be mentioned hereinafter.

The adhesion of the synthetic resin to the material of the lamp cap, which is generally metal, for example copper alloys, such as copper-nickel, brass or tombak, stainless steel, aluminum, new silver or nickel-plated metals, is generally stronger than to glass of the lamp vessel. Nevertheless, the inner surface of the lamp cap where it is in contact with the synthetic resin can be profiled to enlarge the application of the synthetic resin thereto. A good possibility is to use for this purpose an inwardly depressed metal lamp cap. The depression(s) is (are) then at least tangentially enclosed in the synthetic resin.

In a particular embodiment of the lamp according to the invention, a current supply conductor to the light source is clamped between the synthetic resin and the sheath of the lamp cap. In lamp caps having a metal sheath, it has surprisingly been found that a good electrical contact between this sheath and this conductor is obtained. In fact it has been found that it is possible in this manner, for example with Swan-s lamp caps, i.e. Swan lamp caps having only one contact at the base portion and one contact at the sheath, and with Edison lamp caps to connect the contact at the sheath of the lamp cap to a current supply conductor without using a soldering or welding operation. This means a very considerable simplification and acceleration of the manufacturing process, the more so as a current conductor emerging from the lamp over the edge of its cap can be situated at any point along the circumference of this edge. This is in contrast with a current conductor that can emerge from the base portion of the lamp cap only at one given area. Therefore, before this current conductor can be fixed, it has first to be ascertained where this conductor is situated. Another important advantage is that the relevant current supply conductor is now allowed to be so short that it does not emerge from the lamp cap. A loose wire outside the lamp cap, which may be touched in conventional lamps while it is alive, is not possible in this embodiment in which the current supply conductor remains inside the lamp cap. This embodiment renders welding or soldering of contacts entirely superfluous in lamps having two lamp caps each having a sheath contact, such as in a lamp having festoon caps.

Figure 6:
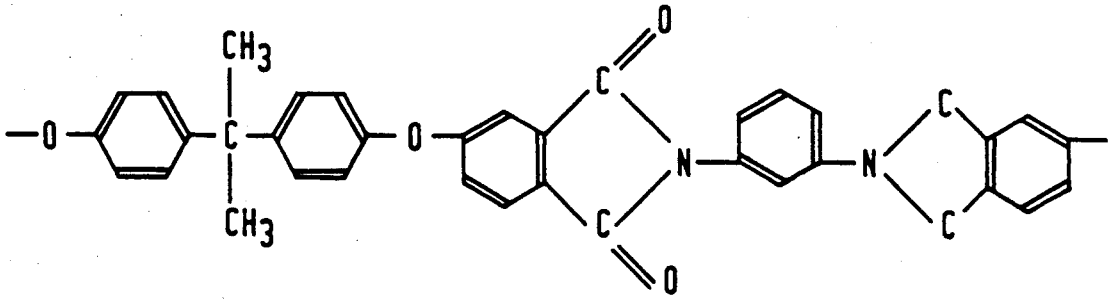
FIG. 6 is a structured formula of a unit of the synthetic resin used in the lamp of FIG. 1.

Very satisfactory results are attained when the synthetic resin is selected from the aromatic polyetherimides, such as polyetherimides marketed under the tradename Ultem by General Electric Plastics and having the structure of a repeating unit shown in FIG. 6 of the drawings. The polyetherimides may have a filling of mineral powders, such as $SiO_2$, $CaCO_3$, MgO, ZnO, $BaSO_4$, $Al_2O_3$, but alternatively of fibres, such as glass fibres.

The lamp according to the invention may be one of several kinds, for example an incandescent lamp, in which the light source is a filament. The filament may be surrounded by an inner bulb which is arranged in the lamp vessel. The lamp may alternatively be a discharge lamp, for example a low-pressure discharge lamp, such as a low-pressure mercury discharge lamp. The light source is in this case an ionizable mercury-containing gas with electrodes that may be arranged in the lamp vessel. Inside the lamp vessel, the gas filling may be present in an inner bulb, such as in a low-pressure sodium discharge lamp. The lamp may alternatively be a high-pressure discharge lamp, such as a high-pressure sodium discharge lamp, which emits at least substantially white light. The light source is in this case a sodium-containing ionizable gas in a crystalline inner bulb provided with electrodes.

The lamp according to the invention can be very readily manufactured. It has proved to be favorable to arrange a preformed ring of a polyetherimide around the hot end portion of the lamp vessel, that made hot during its shaping. It is favorable to carry out this step while this end portion is still hot, for example has a temperature of 400–450° C. due to the operation in which this portion is shaped. In an embodiment of the method, the ring is brought to an elevated temperature, for example 150–200° C. The ring adheres, when it is provided, to the hot surface of the end portion. If desired, the ring around the end portion may then be shaped by means of a jig. The jig may have an elevated temperature, for example of 150–200° C. Subsequently, the lamp cap is provided on the ring. The lamp cap is heated for this purpose at a temperature of about 400–450° C. The temperatures are not critical. At temperatures at the level of 400° C., the synthetic material rapidly softens and adheres. At temperatures at the level of 200° C., the ring retains its shape and does not adhere to objects with which it is in contact. On adhesion to objects of about 400° C., a connection is obtained which becomes stronger upon cooling.

When a current supply conductor is bent around the ring provided on the end portion, an electrical connection is obtained with the lamp cap during the step of providing the lamp cap if this lamp cap has a metal sheath. These steps of connecting the cap and making an electrical contact require only a few, for example 3 to 4 seconds, while, when using a conventional cement, times of up to 25 seconds are required for curing the cement only. As a result, in conventional lamps, the step of mounting the lamp cap is one of the slowest assembling steps, so that the lamp according to the invention and its manufacture provides a material improvement.

In the case of a lamp in which the synthetic resin connects the end portion of the lamp vessel to the lamp cap, in directions transverse to the axis of the lamp vessel the ring of synthetic resin has in a favorable embodiment a conical shape, for example with an apic angle of $2\times5°$. This shape facilitates the step of providing the ring around the end portion of the lamp vessel. In many cases, the lamp vessel is moreover conical at the free end of its end portion, because glass mouldings cannot be made with sharp shapes.

One or more projections at the end portion of the lamp vessel are particularly favorable means for enlarging the grip of the synthetic resin on the lamp vessel. The ring of synthetic resin can then have at its inner surface one or more grooves, which are caused to engage these projections. A ring having a smaller wall thickness can be used while maintaining its enlarged grip if this ring has at its wide end one or more recesses with which the ring laterally engages a projection. These embodiments continue to render it possible to provide the ring around the end portion in a simple manner, by slipping this ring onto it while they nevertheless require only a small quantity of synthetic resin. Similar recesses at the narrow end of the ring or grooves in the outer surface of the ring may be present to receive inward depressions in the lamp cap.

EU PS 186 827 A2 discloses a lamp of pressed glass whose lamp cap is connected via a skirt of synthetic resin to the bottom of the lamp vessel. The sleeve then replaces a metal collar and a glass body through which in conventional lamps of pressed glass the bottom of the lamp vessel is connected to the lamp cap. The skirt of synthetic resin has a wide collar portion with longitudinal slots and internal nose-shaped projections, which under elastic deformation of the collar portion are caused to engage cavities in the bottom of the lamp vessel. As a result, a mechanical coupling is obtained between the lamp vessel and the skirt. At its outer surface the skirt has parts of screw-thread onto which the Edison lamp cap is screwed, while it further has in its outer surface recesses in which the lamp cap is depressed in order to lock the screw connection between the skirt and the lamp cap against displacement. The skirt is consequently secured mechanically both to the lamp vessel and to the lamp cap. The skirt is more than a means for coupling the lamp vessel to the lamp cap. It is an insulator body between the lamp vessel and the lamp cap and a body which causes the length of the lamp to be considerably greater than in the case of a direct connection of the lamp cap to the lamp vessel. Among the synthetic resin that can be used for the sleeve belong polyetherimides.

An embodiment of the lamp and the method according to the invention will be described more fully with reference to the drawings.

In the drawings the lamp of FIG. 1 has a translucent glass lamp vessel 1 having an axis 2 and an end portion 3. A filament 4 serving as the light source is arranged in the lamp vessel 1. In the lamp cap 5, which has a sheath portion 6 and base portion 7, the end portion 3 of the lamp vessel 1 is a thermoplastic synthetic resin 8 which member adheres to the lamp vessel and to the lamp cap. The lamp cap 5 has an electrical contact 11 at the sheath 6 to 5 which a current supply conductor 11 to the light source 4 is connected. A base contact 9 at the base portion 7 is connected to a second current supply conductor 12 to the light source 4. As the thermoplastic synthetic resin ring 8 use is made of a polyetherimide containing 30% by weight of glass fibre.

The synthetic resin ring 8 adheres to the end portion 3 of the lamp vessel 1 in directions transverse to the longitudinal axis 2 of the lamp vessel 1. The synthetic resin ring 8 and the lamp cap 5 consequently surround the end portion 3 respectively, substantially coaxially.

Figure 5:
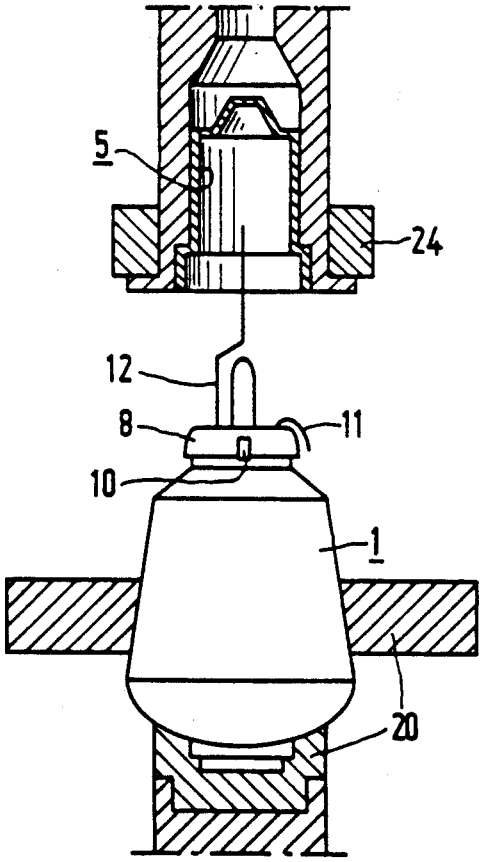
FIG. 5 is a sectional view of an arrangement employed during a third step of the mounting.

The end portion 3 has a non-circular cross-sections transverse to the axis 2 of the lamp vessel 1 in which the end portion 3 is in contact with the synthetic resin. In FIG. 1, this non-circularity is due to a projection 10 which extends transversely to the axis 2 and projects into the synthetic resin ring 8 (FIG. 5).

Figure 3:
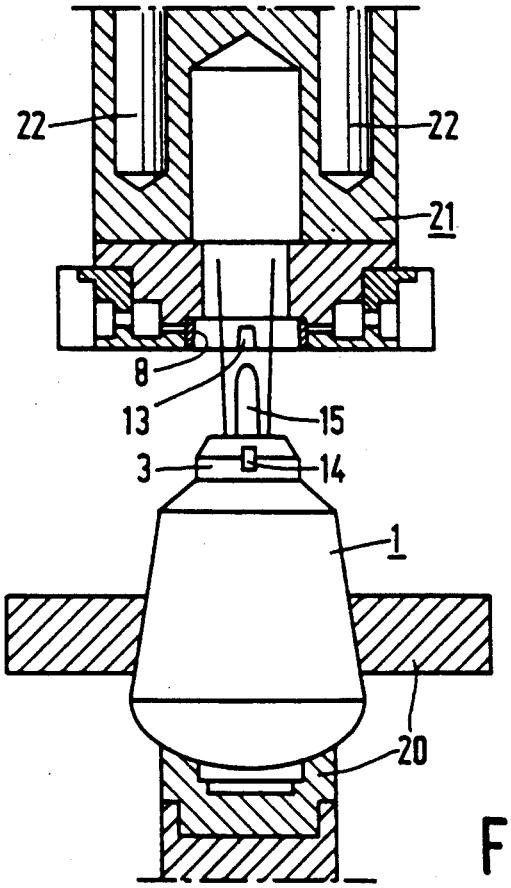
FIG. 3 is a sectional view of an arrangement employed during a first step mounting the lamp cap onto the lamp vessel.

Although this is not visible in FIG. 1, the end portion 3 has diametrically opposite to the projection 10 a second similar projection (14 in FIG. 3). The projections 10, 14 are consequently distributed regularly along the circumference.

The current supply conductor 11 is in electrical contact with the lamp cap 5 on the inner side of this lamp cap due to the fact that this conductor 11 is clamped between the synthetic resin ring 8 and the sheath portion 6 of the lamp cap 5.

Figure 2:
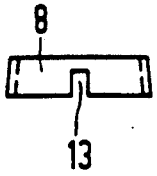
FIG. 2 is a sectional view of a thermoplastic synthetic resin employed in the lamp of FIG. 1.

FIG. 2 shows a conical ring 8 formed of the thermoplastic synthetic resin, the wide end of which is provided with two diametrically opposed recesses 13.

In FIG. 3, the lamp vessel 1 is rotated through 180° with respect to FIG. 1 and is held in position by a holder 20. The end portion 3 has a temperature of 400 to 450° C. due to a shaping and cleaning process, at the end of which the lamp vessel 1 is sealed in a vacuum-tight manner by closing the exhaust tube 15. A thermoplastic synthetic resin ring 8 heated at about 150–200° C. is situated in a holder 21 accommodating heating elements 22. The holders 20, 21 are moved towards each other and the ring 8 is pressed on the end portion 3, the ring melting at its inner surface and adhering to the end portion 3. The recesses 13 in the ring 8 then engage the projections 10, 14. The ring consequently has a profile cooperating with the non-circular cross-sections of said end portion 3. Similar recesses may be present at the narrow end of the ring 8 in order to cooperate with depressions that may be present in the lamp cap 5.

Figure 4:
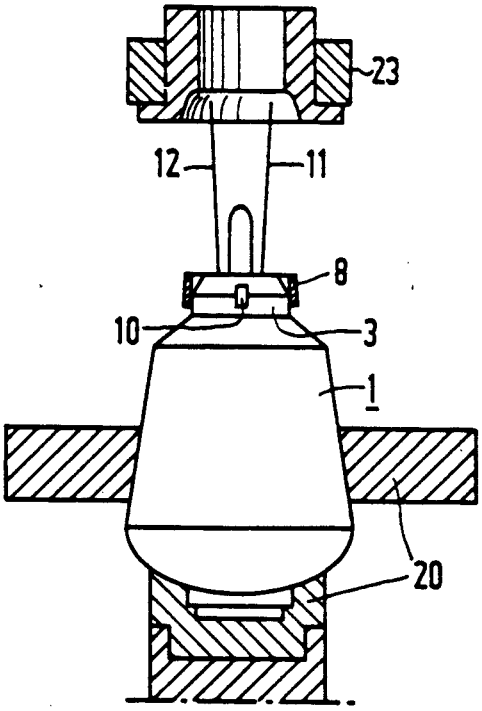
FIG. 4 is a sectional view of an arrangement employed during a second step of the mounting.

In FIG. 4*a*, shaping member which is internally oversized with respect to the interior of the lamp cap 5, is moved to the holder 20 to shape the thermoplastic ring 8.

After the current supply conductor 11 has been shortened and bent and the current supply conductor 12 has been aligned substantially coaxially, a holder 24 (FIG. 5) enclosing a lamp cap 5 (shown diagrammatically), which is heated by means of, for example, a flame to a temperature of about 400 to 450° C., is pressed on the ring 8, this ring melting at its outer surface and adhering to the sheath portion 6, shown in FIG. 1 of the lamp cap 5. After the holder 24 has been removed, the connection of the base contact 9, shown in FIG. 1, with the current supply conductor 12 can be made and the lamp may be cooled by means of an air jet.

Alternatively, the current supply conductor may be shortened before the ring 8 is applied in FIG. 3.

Lamps of the kind shown in FIG. 1, which, however, are not provided with projections 10, 14, and which are manufactured while using a ring 8 of polyetherimide without recesses 13, were compared with similar lamps in which a similar ring was used, made of the thermoplastic polyethersulphone known from the aforementioned British Patent Specification No. 1,380,720.

A number of lamps were stored according to IEC 432 (1982) for 1500 hours at 210° C. The torsional strength of the connection of the lamp caps was measured and compared to lamps that had been stored at room temperature for 1 hour after their manufacture. The results are indicated in Table 1.

TABLE 1

| torsional strength (Nm) after | 1 hr 25° C. | | | 1500 hr 210° C. | | |
|---|---|---|---|---|---|---|
| | average | lowest | standard | average | lowest | standard |
| polyetherimide n = 10 | >6 | >6 | 1.15 | 2.85 | 1.5 | 1.0 |
| polyethersulphone n = 10 | >6 | >6 | 1.15 | 2.63 | 0.8 | 1.0 |

It appears from this table that both synthetic resins yield the same initial adhesion amply surpassing the standard. After the heat treatment, the adhesion provided by the polyetherimide according to the invention is larger than that of the known synthetic resin. The lowest measured value moreover lies amply above the standard, whereas the lowest value of the known synthetic resin lies below the standard.

What is claimed is:

1. An electric lamp provided with:

a translucent lamp vessel having an axis and an end portion, a light source in the lamp vessel, a lamp cap having a sheath portion and a base portion in which said end portion of the lamp vessel is adhesively bound by means of a thermoplastic synthetic resin member which synthetic resin member adheres both to the lamp vessel and to the lamp cap, said lamp cap having an electrical contact to which a current supply conductor to the light source is connected, characterized in that a polyetherimide is used as the thermoplastic synthetic resin.

2. An electric lamp as claimed in claim 1, characterized in that the synthetic resin member connects in directions transverse to the axis of the lamp vessel, the end portion of the lamp vessel to the lamp cap.

3. An electric lamp as claimed in claim 2, characterized in that the end portion of the lamp vessel, where it is in contact with the synthetic resin member has non-circular cross-sections transverse to the axis of the lamp vessel.

4. An electric lamp as claimed in claim 3, characterized in that the end portion of the lamp vessel, comprises a projection which extends transversely to the axis of the lamp vessel and projects into the synthetic resin member.

5. An electric lamp as claimed in claim 4, characterized in that the lamp vessel comprises several of said projections distributed over the circumference of the end portion.

6. An electric lamp as claimed in claim 2, 3, 4 or 5, characterized in that a current supply conductor to the light source is electrically connected to the sheath portion of the lamp cap said conductor only being clamped between the synthetic resin member and the sheath portion of the lamp cap.

7. A method of manufacturing an electric lamp provided with:

a translucent lamp vessel having an axis and an end portion, a light source in the lamp vessel, a lamp cap having a sheath portion and a base portion in which said end portion of the lamp vessel is adhesively bound by means of a thermoplastic synthetic resin member which synthetic resin member adheres both to the lamp vessel and to the lamp cap, said lamp cap having an electrical contact to which a current supply conductor to the light source is connected, characterized in that a polyetherimide ring is applied to the outer surface of the end portion of said lamp vessel which end portion is heated to 400–450° C. and said lamp cap, heated to 400–450° C., is applied to the outer surface of said polyetherimide ring.

8. A method as claimed in claim 7, characterized in that the ring is applied at a temperature of about 150–200° C.

9. A method as claimed in claim 7 or 8, characterized in that the polyetherimide ring is conical.

10. A method as claimed in claim 9, characterized in that the lamp vessel has an end portion which as non-circular cross-sections where it contacts the ring, and in that the ring is has a profile cooperating with said end portion.

11. A method as claimed in claim 10, characterized in that the end portion has at least one projection extending transversely to the axis of the lamp vessel, and in that the ring has at least one recess for this projection.

* * * * *